US008087106B1

(12) United States Patent
Mitchell

(10) Patent No.: US 8,087,106 B1
(45) Date of Patent: Jan. 3, 2012

(54) FLAPPER VALVE APPARATUS AND METHOD OF USE

(76) Inventor: Jack B. Mitchell, Cumming, GA (US)

( * ) Notice: Subject to any disclaimer, the term of this patent is extended or adjusted under 35 U.S.C. 154(b) by 217 days.

(21) Appl. No.: 12/398,921

(22) Filed: Mar. 5, 2009

(51) Int. Cl.
*E03D 1/35* (2006.01)

(52) U.S. Cl. ..... 4/393

(58) Field of Classification Search ..... 4/378, 392, 4/393

See application file for complete search history.

(56) References Cited

U.S. PATENT DOCUMENTS 4,364,129 A 12/1982 Schonger
4,499,616 A * 2/1985 Johnson ..... 4/393
4,536,900 A 8/1985 Hayes
4,841,579 A * 6/1989 Antunez ..... 4/393
5,103,507 A 4/1992 Sprajc et al.
5,117,514 A 6/1992 Richter
6,151,724 A 11/2000 Klingenstein
6,615,415 B1 9/2003 Lai
6,880,181 B2 4/2005 Nichols Roy et al.
2004/0237182 A1 12/2004 Shih

* cited by examiner

*Primary Examiner* — Huyen Le
(74) *Attorney, Agent, or Firm* — Crossley Patent Law; Mark A. Crossley

(57) ABSTRACT

The flapper valve apparatus and method of use provides a flapper valve that is basic and easily installed on the pins of a toilet reservoir overflow tube. The apparatus has sufficient flexibility to allow flexing of the arms and ears for easy installation. The apparatus provides water volume conservation by seating the lower bulb within the valve seat prior to substantial drainage of the reservoir. And, a user can vary the amount of water used in a flush by varying flush handle hold time.

4 Claims, 4 Drawing Sheets

FLAPPER VALVE APPARATUS AND METHOD OF USE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Water conservation has become a very serious issue. Toilet flush volumes are a significant contributor to water waste. Various methods and devices have been proposed to reduce the volume of water used in flushing a toilet. Many such devices require toilet reservoir redesign or toilet valve and valve seat redesign. And, some such devices include complex equipment which is difficult to install and expensive to produce and sell. What has been needed is a basic apparatus that fits most existing flush valves, an apparatus that is easily installed by virtually anyone and reduces the volume of water used in flushing a toilet.

FIELD OF THE INVENTION

The flapper valve apparatus and method of use relates to toilet flush valves and more especially to a flapper valve apparatus and method of use that automatically reduces toilet water flush volume.

SUMMARY OF THE INVENTION

The general purpose of the flapper valve apparatus and method of use, described subsequently in greater detail, is to provide a flapper valve apparatus and method of use which has many novel features that result in an improved flapper valve apparatus and method of use which is not anticipated, rendered obvious, suggested, or even implied by prior art, either alone or in combination thereof.

To attain this, the flapper valve apparatus and method of use is basic and easily installed on the pins of a toilet reservoir overflow tube. The apparatus has sufficient flexibility to allow flexing of the arms and ears for easy installation. Two embodiments of the apparatus are provided. One embodiment provides arms that are sufficiently flexible to allow elevation of the lower bulb from the valve seat, and return. One embodiment is more rigid and provides for the ears with orifices to freely pivot about the pins of the existing overflow tube of a toilet. Both embodiments provide water volume conservation by seating the lower bulb within the valve seat prior to substantial drainage of the reservoir. And, a user can vary the amount of water used in a flush by varying flush handle hold time. For example, actuating the toilet flush handle lifts the apparatus lower bulb off of the valve seat, allowing water to drain from the reservoir to flush the bowl. The apparatus lower bulb, by virtue of the weighted upper bulb, returns to the valve seat more quickly than a conventional flapper, thereby stopping water flow from the reservoir sooner than the conventional flapper. Holding a handle in a flush position longer, with the present apparatus, allows a user to modulate water flow from the reservoir, allowing more water volume drainage from the reservoir as desired.

Each feature of the apparatus is important. For example, the first and second ears provide greater stability in retaining the apparatus in correct position on the pins of an overflow tube. Likewise, the arm extension and medial extensions perform a like function. The parabolic shape of the upper bulb has been experimentally established as the ideal shape. Weighting the upper bulb further enables correct performance of the apparatus, versus weighting the lower bulb. The semicircular lower bulb flattened center portion further provides ideal operation of the apparatus. The forward ear ensures that a pull link is not torn from the flange, as can occur without such a reinforcement. The substantially coincidental top and lower bulb base locations further provides optimal apparatus function.

The apparatus provides water conservation without undue parts expense or labor. For example, toilets are typically long lived. An average expense for a new toilet is about $250. New toilets typically use about 1.6 gallons per flush. However, by comparison, older toilets typically use about 3 gallons per flush. Toilet replacement to save water is therefore a costly pathway, while replacement of a conventional flapper valve with the present apparatus is relatively inexpensive and retains the use of the existing toilet. Additionally, a plumber is not needed to install the present apparatus, but typically is in toilet replacement, another cost savings.

The present apparatus also saves time in saving water. A typical flush cycle requires about 2 minutes for reservoir volume replenishment. The present apparatus provides for reservoir replenishment in about 30 seconds.

The apparatus weighs about 3.70 to 4.00 ounces. By comparison, a typical flapper weighs about 1.92 to 2.0 ounces. While various materials are used in providing the weight within the top bulb, brass, lead, and copper provide excellent function.

Thus has been broadly outlined the more important features of the improved flapper valve apparatus and method of use so that the detailed description thereof that follows may be better understood and in order that the present contribution to the art may be better appreciated.

An object of the flapper valve apparatus and method of use is to conserve water.

Another object of the flapper valve apparatus and method of use is to allow user modulation.

A further object of the flapper valve apparatus and method of use is to be easily installed by virtually anyone.

An added object of the flapper valve apparatus and method of use is to be quickly installed.

And, an object of the flapper valve apparatus and method of use is to fit toilet flapper valve seats and ball valve seats.

A further object of the flapper valve apparatus and method of use is to reduce toilet flush water volume as inexpensively as possible.

Another object of the flapper valve apparatus and method of use is to weigh about twice as much as a conventional flapper.

These together with additional objects, features and advantages of the improved flapper valve apparatus and method of use will be readily apparent to those of ordinary skill in the art upon reading the following detailed description of presently preferred, but nonetheless illustrative, embodiments of the improved flapper valve apparatus and method of use when taken in conjunction with the accompanying drawings.

In this respect, before explaining the current embodiments of the improved flapper valve apparatus and method of use in detail, it is to be understood that the flapper valve apparatus and method of use is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved flapper valve apparatus and method of use. It is therefore important that the claims be regarded as including such equivalent constructions insofar as they do not depart from the spirit and scope of the flapper valve apparatus and method of use. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the flapper valve apparatus and method of use generally designated by the reference number 10 will be described.

Figure 3:
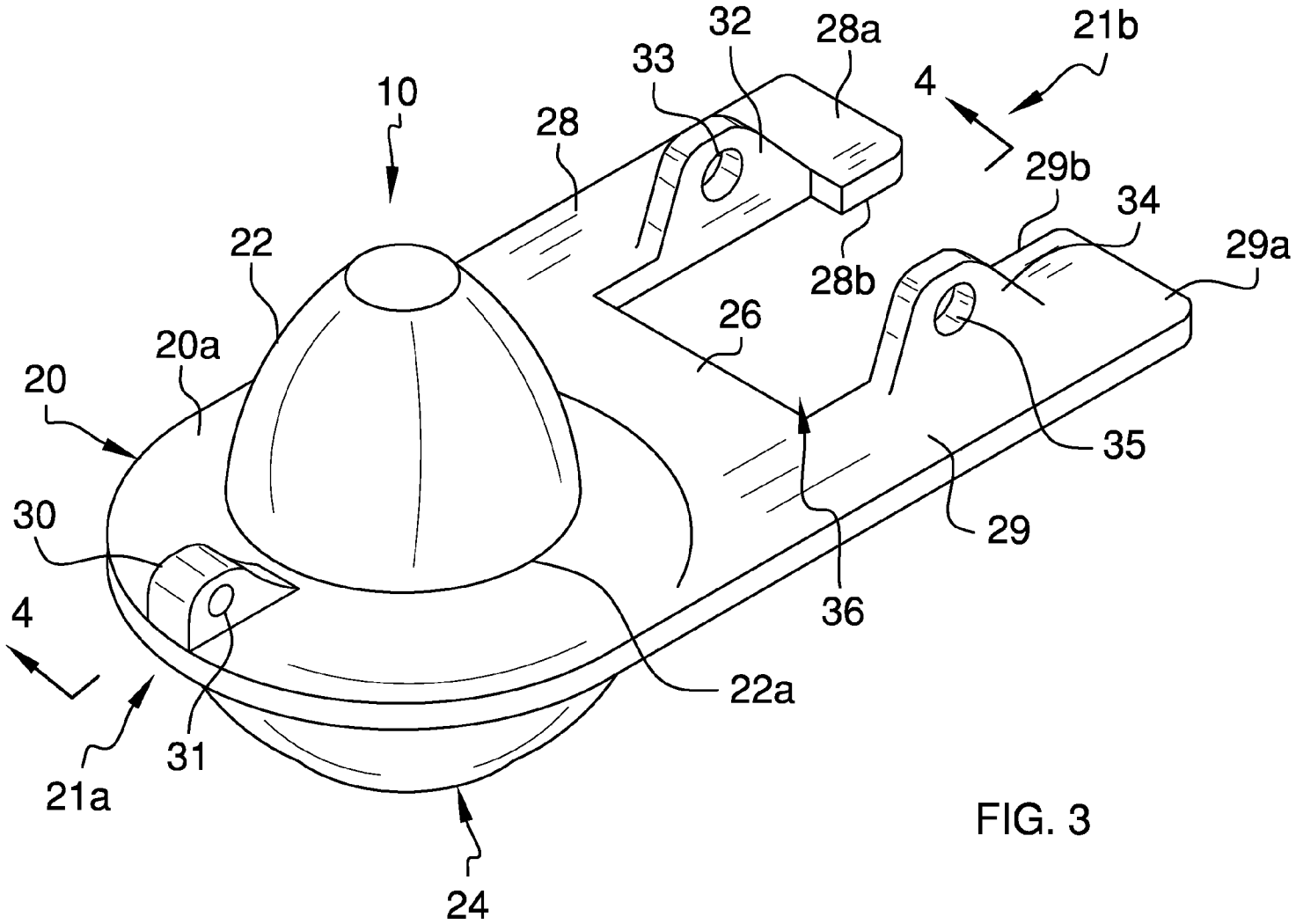
FIG. 3 is a perspective view.
Figure 4:
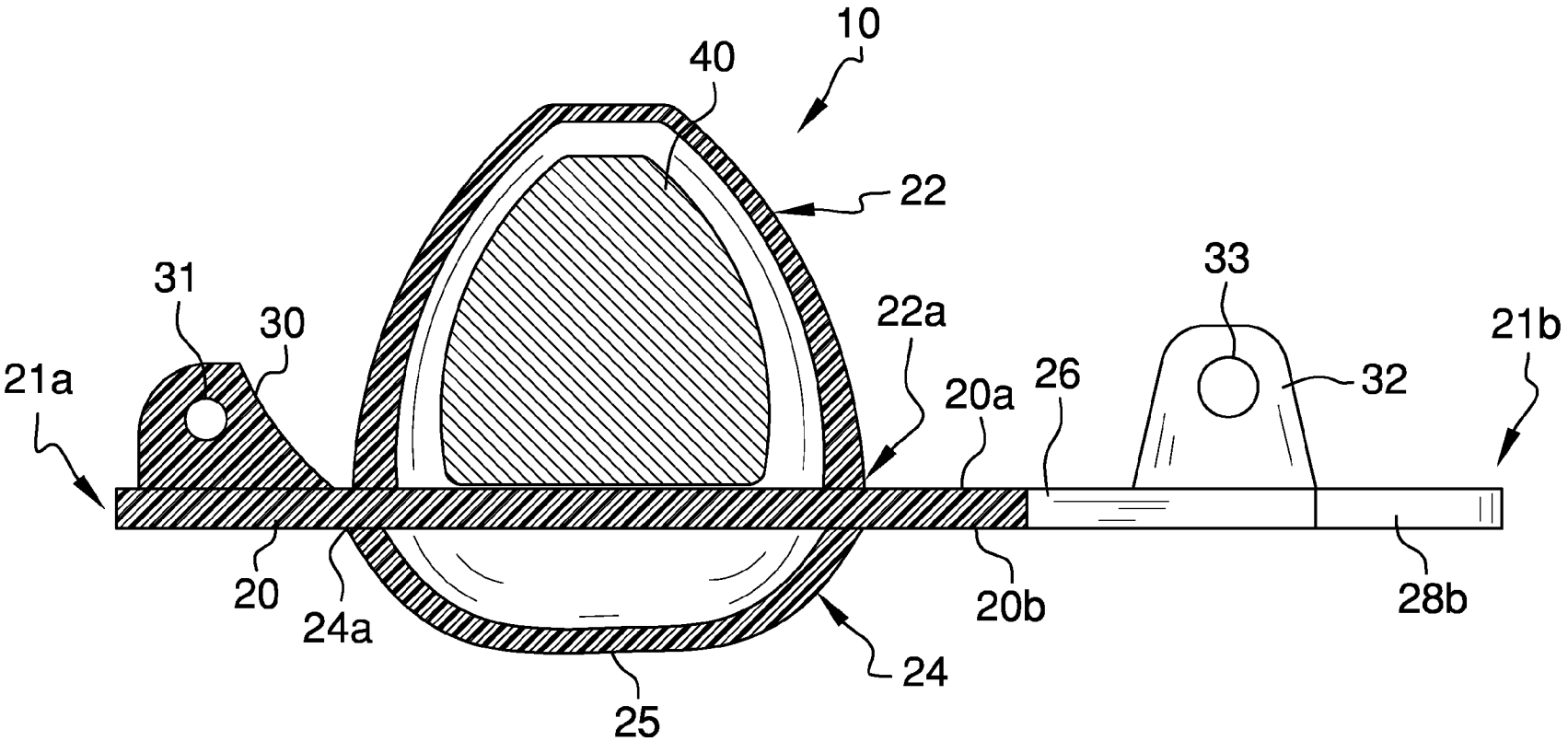
FIG. 4 is a cross sectional view of FIG. 3, taken along the line 4-4.

Referring to FIGS. 3 and 4, the apparatus 10 comprises a top 20*a* spaced apart from a bottom 20*b*, and a first end 21*a* spaced apart from a second end 21*b*. The apparatus 10 further comprises a flat flange 20. The forward ear 30 is disposed on the top 20*a* adjacent to the first end 21*a* of the flat flange 20. The hook orifice 31 is disposed within the forward ear 30.

Figure 1:
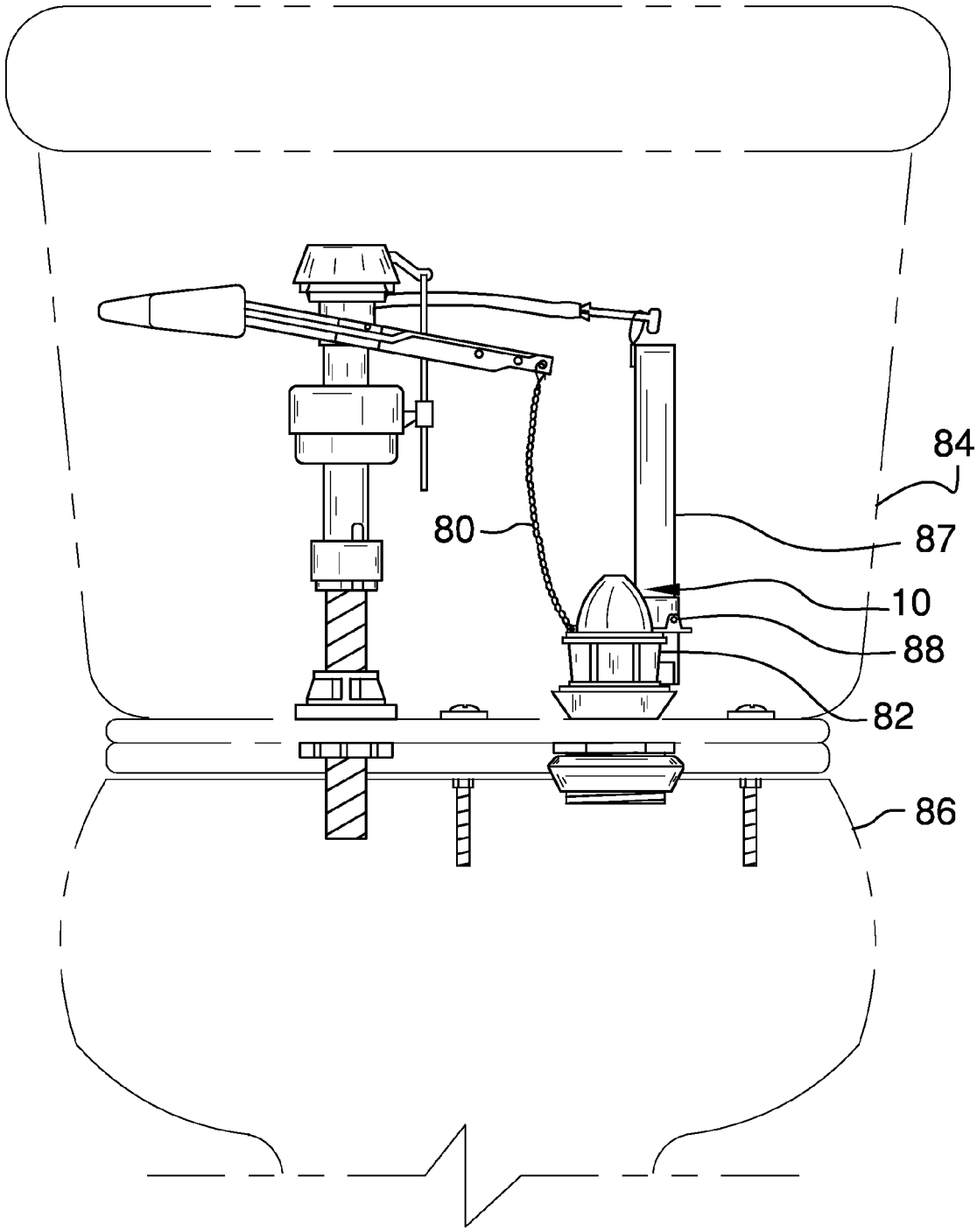
FIG. 1 is a front elevation view of the apparatus installed and seated in the valve seat.
Figure 2:
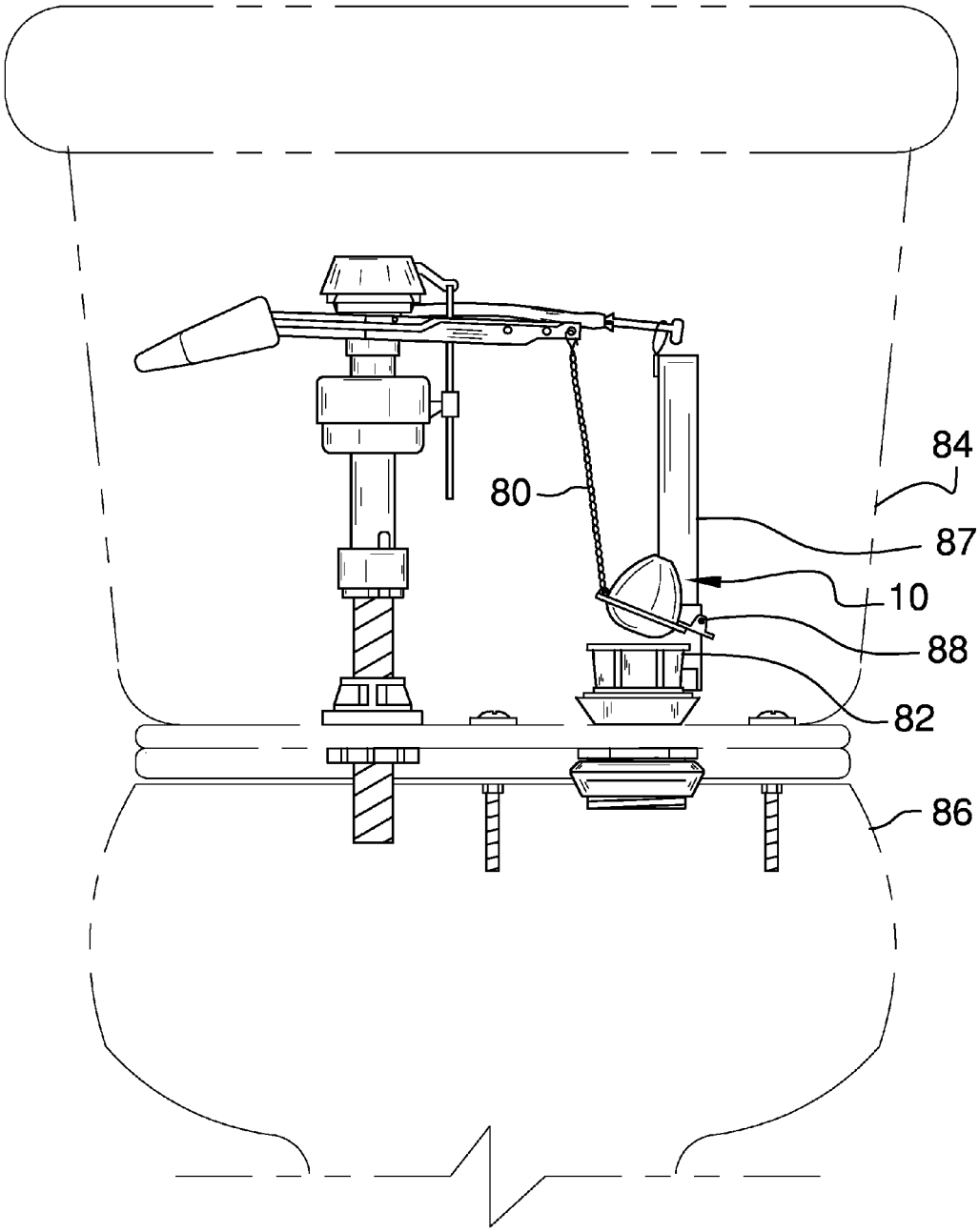
FIG. 2 is a front elevation view of the apparatus installed and lifted off of the valve seat.

Referring to FIGS. 1 and 2, the hook orifice 31 is removably hooked by an existing pull link 80 of an existing toilet reservoir 84.

Referring again to FIGS. 2, 3, and 4, the parabolic top bulb 22 has a top bulb base 22*a* extended from the flange 20 top 20*a*. The top bulb 22 is proximal to the first end 21*a*. A weight 40 is disposed within the top bulb 22. The semicircular lower bulb 24 has a lower bulb base 24*a* extended from the flange 20 bottom 20*b*. The lower bulb base 24*a* substantially mirrors the top bulb base 22*a*. The lower bulb 24 further features a flattened center portion 25. The first arm 28 is extended rearwardly from the flange 20 toward the second end 21*b*. The second arm 29 is extended rearwardly from the flange 20 toward the second end 21*b*. The second arm 29 is spaced apart from the first arm 28. The gap 36 is disposed between the first arm 28 and the second arm 29. The gap 36 is removably fitted around an existing overflow tube 87 of the toilet reservoir 84, which is illustrated above a typical toilet bowl 86.

Continuing to refer to FIGS. 3 and 4, the first ear 32 is extended upwardly from the first arm 28. The first ear 32 is adjacent to the gap 36. The first ear orifice 33 is disposed in the first ear 32. The first ear orifice 33 is removably positioned on an existing pin 88 of the overflow tube 87. The second ear 34 is extended upwardly from the second arm 29. The second ear 34 is adjacent to the gap 36. The second ear orifice 35 is disposed in the second ear 34. The second ear orifice 35 is removably positioned on an existing pin 88 of the overflow tube 87. The first extension 28*a* is disposed rearwardly on the first arm 28. The first extension 28*a* extends from the first ear 32 to the second end 21*b*. The second extension 29*a* is disposed rearwardly on the second arm 29. The second extension 29*a* extends from the second ear 34 to the second end 21*b*. The first medial extension 28*b* is disposed medially on the first extension 28*a*. The second medial extension 29*b* is disposed medially on the second extension 29*a*.

Referring again to FIG. 1, the installed apparatus 10 is seated within the existing valve seat 82 such that water cannot drain from the toilet reservoir 84.

Referring to FIG. 2, the installed apparatus 10 is lifted from the seat 82 by the pull link 80 so that water is allowed to drain from the reservoir 84 in order to flush the toilet bowl 86.

Referring again to FIGS. 1-4, the method of use of the apparatus 10 importantly provides an efficient and basic means of replacing an existing toilet reservoir 84 flapper valve with the apparatus 10 in order to save water. The method of use requires the present apparatus and consists of turning off the water supply to the toilet reservoir 84, flushing the toilet, unhooking the conventional flapper from the pull link 80, removing the conventional flapper, installing the apparatus 10 by flexing the arms and ears such that the lower bulb 24 removably fits the existing valve seat 82, hooking the pull link 80 to the hook orifice 31 of the forward ear 30, turning the water on, and flushing the toilet.

With respect to the above description then, it is to be realized that the optimum dimensional relationships for the parts of the flapper valve apparatus and method of use, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the flapper valve apparatus and method of use.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the flapper valve apparatus and method of use may be used.

Therefore, the foregoing is considered as illustrative only of the principles of the flapper valve apparatus and method of use. Further, since numerous modifications and changes will readily occur to those skilled in the art, it is not desired to limit the flapper valve apparatus and method of use to the exact construction and operation shown and described, and accordingly, all suitable modifications and equivalents may be resorted to, falling within the scope of the flapper valve apparatus and method of use.

What is claimed is:

1. A flapper valve apparatus, comprising:

a top spaced apart from a bottom, a first end spaced apart from a second end;

a flat flange;

a forward ear disposed on the top adjacent to the first end;

a hook orifice disposed within the forward ear, the hook orifice removably hooked by an existing pull link of an existing toilet reservoir;

a parabolic top bulb having a top bulb base extended from the flange top, the top bulb proximal to the first end;

a parabolic weight configured to be contained within the parabolic top bulb;

a semicircular lower bulb having a lower bulb base extended from the flange bottom, the lower bulb base substantially mirroring the top bulb base;

a flattened center portion disposed downwardly in the lower bulb;

a first arm extended rearwardly from the flange toward the second end;

a second arm extended rearwardly from the flange toward the second end, the second arm spaced apart from the first arm;

a gap disposed between the first arm and the second arm, the gap removably fitted around an existing overflow tube of the toilet reservoir;

a first ear extended upwardly from the first arm, the first ear adjacent to the gap;

a first ear orifice in the first ear, the first ear orifice removably positioned on an existing pin of the overflow tube;

a second ear extended upwardly from the second arm, the second ear adjacent to the gap;

a second ear orifice in the second ear, the second ear orifice removably positioned on an existing pin of the overflow tube.

2. The apparatus according to claim 1 further comprising a total weight of about 3.70 to 4.0 ounces.

3. A flapper valve apparatus, comprising:

a top spaced apart from a bottom, a first end spaced apart from a second end;

a flat flange;

a forward ear disposed on the top adjacent to the first end;

a hook orifice disposed within the forward ear, the hook orifice removably hooked by an existing pull link of an existing toilet reservoir;

a parabolic top bulb having a top bulb base extended from the flange top, the top bulb proximal to the first end;

a parabolic weight configured to be contained within the parabolic top bulb;

a semicircular lower bulb having a lower bulb base extended from the flange bottom, the lower bulb base substantially mirroring the top bulb base;

a flattened center portion disposed downwardly in the lower bulb;

a first arm extended rearwardly from the flange toward the second end;

a second arm extended rearwardly from the flange toward the second end, the second arm spaced apart from the first arm;

a gap disposed between the first arm and the second arm, the gap removably fitted around an existing overflow tube of the toilet reservoir;

a first ear extended upwardly from the first arm, the first ear adjacent to the gap;

a first ear orifice in the first ear, the first ear orifice removably positioned on an existing pin of the overflow tube;

a second ear extended upwardly from the second arm, the second ear adjacent to the gap;

a second ear orifice in the second ear, the second ear orifice removably positioned on an existing pin of the overflow tube;

a first extension disposed rearwardly on the first arm, the first extension from the first ear to the second end;

a second extension disposed rearwardly on the second arm, the second extension from the second ear to the second end;

a first medial extension disposed medially on the first extension;

a second medial extension disposed medially on the second extension.

4. The apparatus according to claim 3 further comprising a total weight of about 3.70 to 4.0 ounces.

* * * * *